US006178563B1

(12) United States Patent
Helfet

(10) Patent No.: US 6,178,563 B1
(45) Date of Patent: Jan. 30, 2001

(54) TOILET DEODORIZER

(76) Inventor: Leon Helfet, 1539 San Rafael Way, Camarillo, CA (US) 93012

( * ) Notice: Under 35 U.S.C. 154(b), the term of this patent shall be extended for 0 days.

(21) Appl. No.: 09/500,986

(22) Filed: Feb. 15, 2000

Related U.S. Application Data

(60) Provisional application No. 60/126,982, filed on Mar. 29, 1999.

(51) Int. Cl.[7] ..... E03D 9/02
(52) U.S. Cl. ..... 4/213; 4/222; 4/223
(58) Field of Search ..... 4/213, 223, 228.1, 4/229, 230, 222

(56) References Cited

U.S. PATENT DOCUMENTS

| | | | | |
|---|---|---|---|---|
| 548,870 | | 10/1895 | Hager . | |
| 595,382 | | 12/1897 | Freeman . | |
| 641,238 | * | 1/1900 | Ruthven | 4/223 |
| 713,977 | | 11/1902 | Gallagher . | |
| 866,400 | | 9/1907 | Stevens . | |
| 1,218,882 | | 3/1917 | Macy . | |
| 2,961,664 | | 11/1960 | Davidison | 4/229 |
| 3,088,125 | | 5/1963 | Southwood | 4/222 |
| 3,316,559 | | 5/1967 | Ewing et al. | 4/223 |
| 5,307,525 | * | 5/1994 | O'Brien | 4/223 |

FOREIGN PATENT DOCUMENTS

| | | | | |
|---|---|---|---|---|
| 23280 | * | 3/1985 | (GB) | 4/222 |

* cited by examiner

*Primary Examiner*—Charles R. Eloshway
(74) *Attorney, Agent, or Firm*—Jack C. Munro

(57) ABSTRACT

A toilet deodorizer comprising a pump housing in the form of a cylinder 52 and a piston 54. The cylinder 52 is to be mounted on the movable toilet seat 14 of a conventional toilet. When sitting on the toilet seat, the toilet seat moves which causes a piston 54 to be moved within the cylinder 52 which causes liquid to be dispensed from a pump chamber 50 through an outlet valve 100 in contact with a deflector plate 134 which disperses the liquid within a wide area of the toilet bowl 10. When the user gets up from the toilet seat, the toilet seat is lifted which causes retraction movement between the piston 54 and the cylinder 52 which causes a new quantity of liquid to be pulled through an inlet valve 44 into the pump chamber while maintaining the outlet valve closed.

5 Claims, 4 Drawing Sheets

TOILET DEODORIZER

This application is directed to disclose subject matter which was previously disclosed in Provisional Application 60/126,982, filed Mar. 29, 1999 by the same inventor.

BACKGROUND OF THE INVENTION

1) Field of the Invention

The subject matter of this invention relates to applying of a small quantity of a deodorizing liquid within a toilet bowl during a single usage of the toilet bowl when being utilized for the discharge of solid and liquid waste.

2) Description of the Prior Art

A toilet comprising a ceramic bowl which is mounted on a floor is in exceedingly common use within most civilized countries. The toilet is to function to dispose of human solid and liquid waste into a sewage system. Toilets are mounted within homes, businesses, recreational vehicles and boats. It is common to mount a ring member known as a seat about the opening into the toilet bowl. The seat is pivotly mounted to the toilet bowl so as to be movable from a lower position in contact with the toilet bowl to an upper position located substantially ninety degrees relative to the toilet bowl.

When a human discharges solid waste there is created noxious odors. It is generally preferable to eliminate these noxious odors as rapidly as possible. One common way to eliminate these odors is by utilizing of an exhaust fan in conjunction with the room in which the toilet is mounted with the purpose of the exhaust fan to remove and discharge the noxious odors into the ambient. Another way that noxious odors are eliminated is by the application of an odor destroying liquid within the toilet bowl.

In the past, there have been designed numerous different types of devices that are to work in conjunction with the toilet bowl that apply a quantity of odor destroying liquid within the toilet bowl during occupancy of the seat. However, in the past these toilet bowl deodorizing systems have had certain disadvantages which have resulted in their non-utilization. The primary disadvantage is that these systems are large in size and therefore, from an appearance point of view, make for an unattractive addition to the structure of the toilet. Another disadvantage is that the systems are difficult to clean not providing for easy disassembly and reassembly for purposes of cleaning. A further disadvantage is that the systems do not necessarily dispense a precise quantity of deodorizing liquid with sometimes dispensing a larger amount of liquid and other times dispensing a smaller and ineffective amount of deodorizing liquid. It would be desirable to design a system that dispensed a precise quantity of liquid which was the correct quantity required.

SUMMARY OF THE INVENTION

The structure of the present invention relates to a toilet deodorizer in the form of a pump housing which is to be mounted between the toilet seat and the toilet bowl. The pump housing actually comprises a piston and cylinder arrangement with there being formed within the pump housing a pump chamber. The piston of the pump housing is biased continuously by a spring toward an expanded position. The pump housing includes an inlet valve and an outlet valve. The inlet valve is to connect to a liquid storage reservoir. The outlet valve is to include an outlet orifice that directs the liquid toward the interior of the toilet bowl. The pump housing is to be removably mounted on a deflector plate with this deflector plate to include a deflecting surface to which the stream of liquid from the outlet valve is to be directed and then dispersed into a fanned series of droplets within the interior of the toilet bowl. Sitting on the seat will cause the disbursement of a precise quantity of the liquid to within the interior of the toilet bowl. Removing of one's body from the toilet seat will cause the toilet seat to be moved to a canted position which will result in a new quantity of liquid being extracted from the storage reservoir and confined within the pump chamber making available a further quantity of liquid for the next usage.

One of the objectives of the present invention is to construct a toilet deodorizing apparatus which can be easily and quickly mounted in conjunction with the toilet seat of a conventional toilet by even of the most unskilled individual and which is simple in construction, strong, durable, compact, of light weight and which can be manufactured at low cost.

Another objective of the present invention is to construct a toilet deodorizing apparatus which provides for the ejecting of a precise quantity of deodorizing liquid within the toilet bowl each and every time of dispensing.

The primary objective of the present invention is to provide a new and unique toilet deodorizing apparatus for mounting on the toilet seat of a conventional toilet which is responsive to use of the toilet to automatically release a precise quantity of deodorizing liquid during use of the toilet.

DETAILED DESCRIPTION OF THE PREFERRED EMBODIMENT

Figure 1:
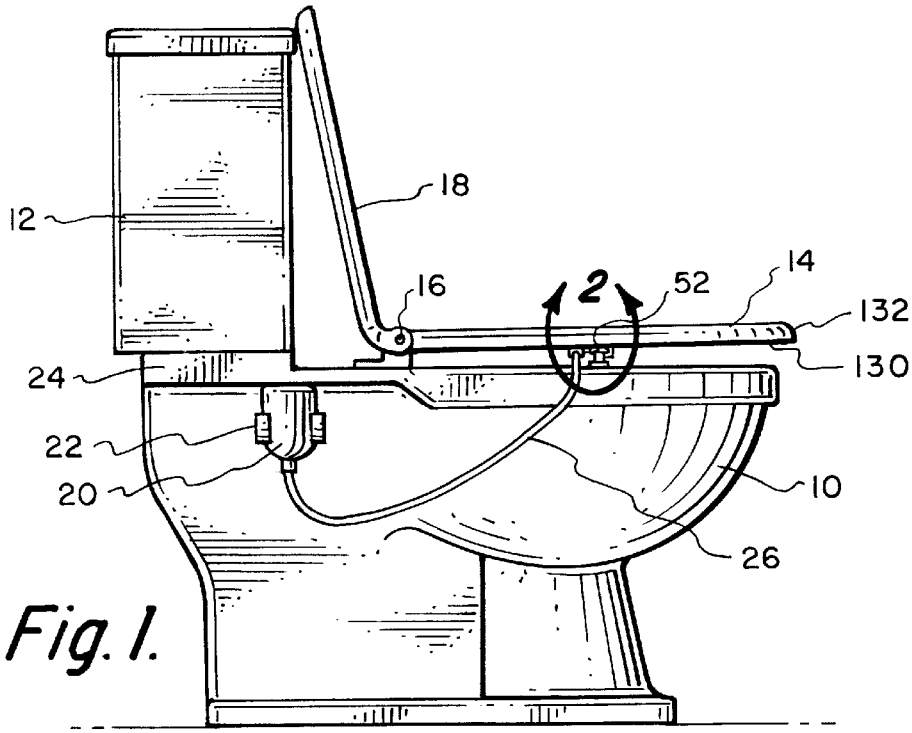
FIG. 1 is a side elevational view of a conventional toilet upon which has been installed the toilet deodorizer of the present invention.
Figure 2:
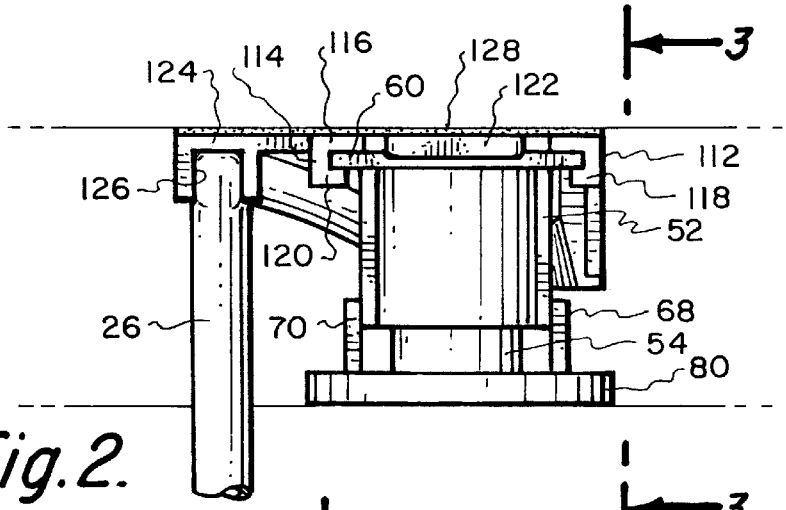
FIG. 2 is an enlarged view of the pump housing of the toilet deodorizer of the present invention taken along line 2—2 of FIG. 1.
Figure 3:
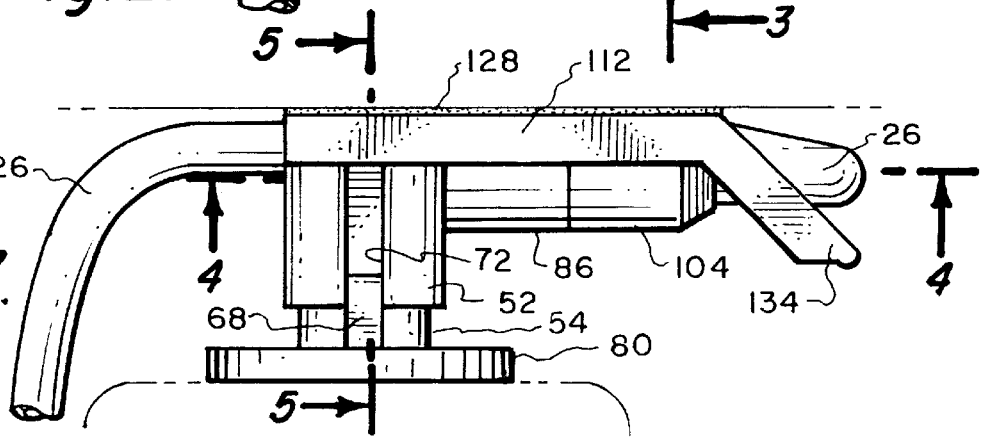
FIG. 3 is a front view of the pump housing of the toilet deodorizer of the present invention taken along line 3—3 of FIG. 2.
Figure 4:
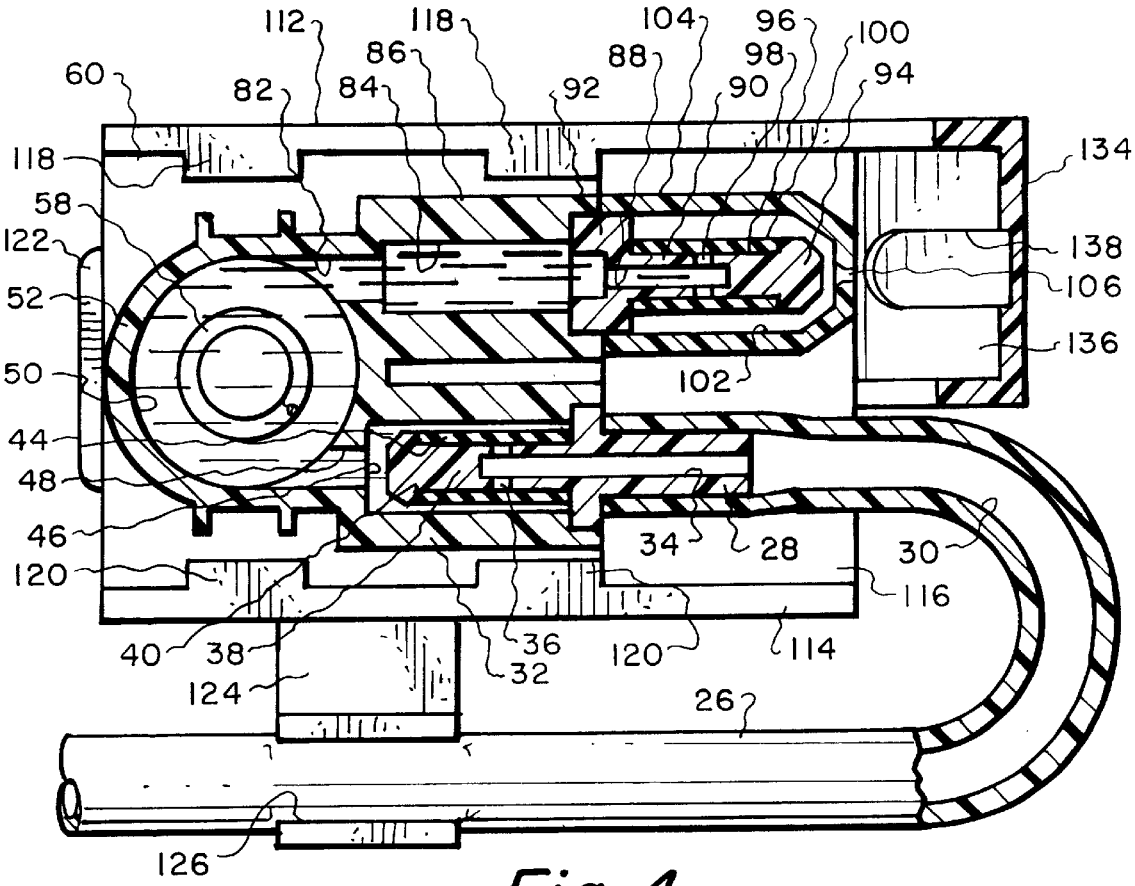
FIG. 4 is a longitudinal cross-sectional view through the pump housing of the toilet deodorizer of the present invention in the position for usage taken along line 4—4 of FIG. 3.

Referring particularly to the drawings, there is shown in FIG. 1 a conventional toilet bowl 10 which has an interior chamber, which is not shown. Mounted on the toilet bowl 10 is a water tank 12 and a seat 14. The seat 14 comprises a ring, which is not shown, and is designed to be in a lower position to be located about the opening to within the interior of the toilet bowl 10. The seat 14 is attached to the toilet bowl 10 at a hinge joint 16. Also attached at the hinge joint 16 is a lid 18 which can be pivoted and placed down against the seat 14 in order to completely enclose the opening within the toilet bowl 10.

Mounted in conjunction with the toilet bowl 10 and seat 14 is the toilet deodorizer of this invention. The toilet deodorizer includes a liquid storage container 20 which is mounted by a mounting bracket 22 under a flange 24 which forms part of the toilet bowl 10. The location of the mounting bracket 22 is to be installed according to the desires of the user. The liquid storage container 20 is adapted to be readily removable from the bracket 22 so as to replaced when the storage container 20 becomes empty. Liquid from the liquid storage container 22 is to be conducted into a tube 26. The outer end of the tube 26 is to be attached to an inlet connector 28. The inlet connector 28 is merely force fitted to within the internal passage 30 of the tube 26. The inlet connector 28 is part of an inlet valve which is mounted within an inlet valve housing 32.

Within the connector 28 is located a passage 34. It is to be noted that the tubing 26 is designed to be flexible so as to be readily bendable. However, the connector 28 and the housing 32 are designed to be constructed of rigid plastic. The passage 34 terminates in an inlet orifice arrangement 36 which is mounted within an inlet shaft 38. The inlet shaft 38 is constructed also of rigid plastic and is integrally connected with the connector 28. The inlet shaft 38 terminates in an enlarged head 40. Between the enlarged head 40 and the connector 28 is formed an annular recess 42.

Mounted within the annular recess 42 is a resilient sleeve 44. Typical material of construction for the resilient sleeve 44 would be silicone or other similar material. The sleeve 44 is to be located in a tight fitting manner within the annular recess 42 and be positioned against the outlet shaft 38 so as to close the outlet orifice arrangement 36.

Figure 5:
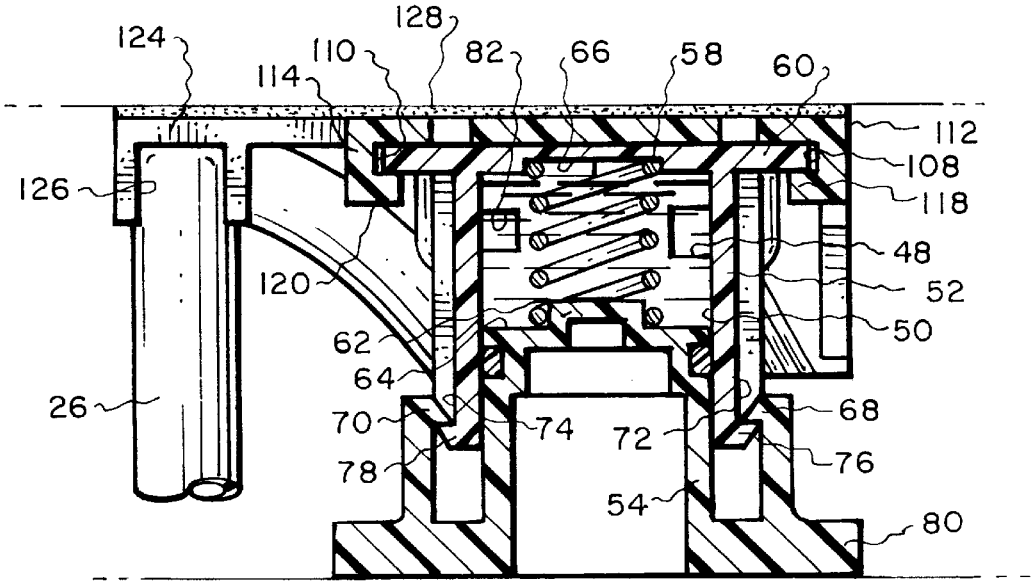
FIG. 5 is a transverse cross-sectional view through the pump housing of the toilet deodorizer of the present invention taken along line 5—5 of FIG. 3 showing the pump housing in the expanded position.

The outlet shaft 38 and the enlarged head 40 are mounted within an inlet chamber 46. The inlet chamber 46 connects by passage 48 to the pump chamber 50 contained within a cylinder 52 which also is to be referred to as a fixed member. Also mounted within the pump chamber 50 is a movable member known as a piston 54. The piston 54 includes an O-ring seal 56. The piston 54 is to be slidingly movable within the pump chamber 50 with the O-ring seal 56 producing a fluid-tight enclosed chamber for the pump chamber 50. Also mounted within the pump chamber 50 is a coil spring 58. One end of the coil spring 58 abuts against base plate 60 of the cylinder 52 with the opposite end of the coil spring 58 surrounding protrusion 62 formed on the inner surface 64 of the piston 54. The base plate 60 includes a recess 66 within which is located the coil spring 58. The recess 66 and the protrusion 62 function as a retainer to centrally position the coil spring 58. The function of the coil spring 58 is to exert a continuous bias between the cylinder 52 and the piston 54 tending to locate the piston 54 in an expanded position, which is shown in FIG. 5 of the drawings. In this expanded position, there are a pair of hook members 68 and 70 which ride within respective grooves 72 and 74 which are formed on the exterior surface of the cylinder 52. The hook member 68 abuts against ledge 76 and hook member 70 abuts against ledge 78 in this expanded position. The coil spring 58 is expanded its maximum amount in FIG. 5. Applying a compressive force between the cylinder 52 and the piston 54 will result in the piston 54 moving within the pump chamber 50 with hook member 68 riding within the groove 72 and hook member 70 riding within the groove 74. The piston 54 terminates in an enlarged ring 80.

The pump chamber 50 connects by a passage 82 to an outlet chamber 84 formed within an outlet housing 86. The outlet chamber 84 connects to passage 88 formed within outlet valve shaft 90. The base portion 92 of the outlet valve shaft 90 is fixedly mounted to the outlet housing 86. The outlet valve shaft 90 includes an enlarged head 94 at its outer end. Located between the enlarged head 94 and the base portion 92 is an annular recess 96. Formed within the annular recess 96 and through the outlet valve shaft 90 is an outlet orifice arrangement 98. Mounted in a tight fitting manner within the annular recess 96 is a resilient sleeve 100 which is normally constructed of rubber. The resilient sleeve 100 normally functions to close the outlet orifice arrangement 98. The enlarged head 94, the outlet shaft 90 and the resilient sleeve 100 are contained within a nozzle chamber 102 which are formed within a nozzle 104. The nozzle 104 is fixedly mounted to the outlet housing 86. The nozzle 104 includes a nozzle opening 106.

The base plate 60 is to be removably engaged and disengaged from side rail slots 108 and 110 which are formed within respective sidewalls 112 and 114 of a mounting plate 116. The base plate 60 is retained within the side rail slot 108 by a pair of protruding flanges 118. The base plate 60 is also held in engagement with the side rail slot 110 by means of a similar pair of protruding flanges 120. The base plate 60, upon which is mounted the cylinder 62, the piston 54, the inlet valve housing 32 and the outlet valve housing 86, can be readily engaged and disengaged from the mounting plate 116. When in the completely engaged position with the mounting plate 116, a detent flange 122 functions to securely lock the cylinder 52 to the mounting plate 116. The mounting plate 116 also includes a side extension 124 within which is formed a groove 126. The tube 26 is to be mounted within the groove 126 so as to be fixedly positioned relative to the mounting plate 116. An adhesive pad 128 is to be secured to the mounting plate 116. The adhesive pad 128 is then to be secured to the undersurface 130 of the toilet seat 14 at any particular desired location according to the user. Typically, the adhesive pad 128 is to be mounted about midway between the tip 132 of the toilet set 14 and the hinge 16. It is to be understood that this mounting of the adhesive pad 128 is only on one side of the toilet seat 14. For balance reason, you will have to have a similar type of unit mounted on the opposite side of the toilet seat 14 with generally that unit comprising, in essence, a mounting plate 116, cylinder 52 and piston 54 which is strictly for the purpose of keeping the toilet seat 14 level when the toilet seat 14 is occupied. This balancing unit is not shown.

The mounting plate 116 has integrally attached thereto a deflecting plate 134. The deflecting plate 134 includes a deflecting surface 136. The deflecting surface 136 includes a main groove 138 from which may extend a fanned series of channels 140.

The operation of the toilet deodorizer of this invention is as follows: The mounting plate 116 is installed on the undersurface 130 of the toilet seat 14 so that the deflecting plate 134 is located directly adjacent the opening within the toilet bowl 10 providing access into the interior chamber of the toilet bowl 10. Once the mounting plate 116 is so installed, the base plate 60 is then snapped into position within the side rail slots 108 and 110. This snapping into position is provided by the detent flange 122 connecting with the back edge of the base plate 60. It is to be understood that when it is desired to remove the baseplate 60 from the side rail slots 108 and 110, it is only necessary to physically bend slightly in an upward direction the detent flange 122 which will permit the base plate 60 to be withdrawn from the side rail slots 108 and 110. Initially, the toilet deodorizer of this invention will be preloaded with deodorizing liquid contained within the pump chamber 50.

Figure 6:
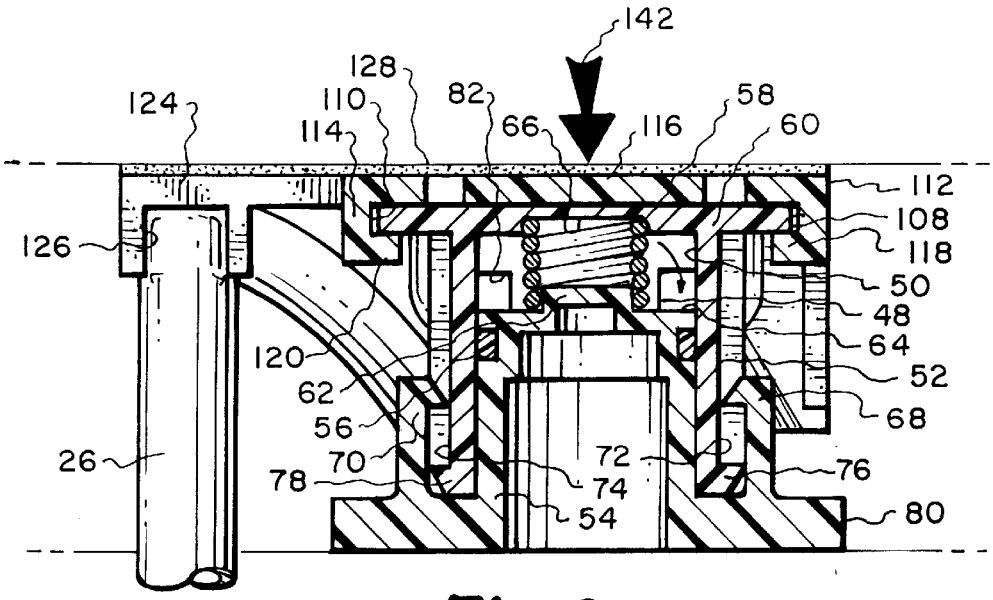
FIG. 6 is a view similar to FIG. 5 but showing the pump housing of the toilet deodorizer of the present invention in the compressed position.
Figure 7:
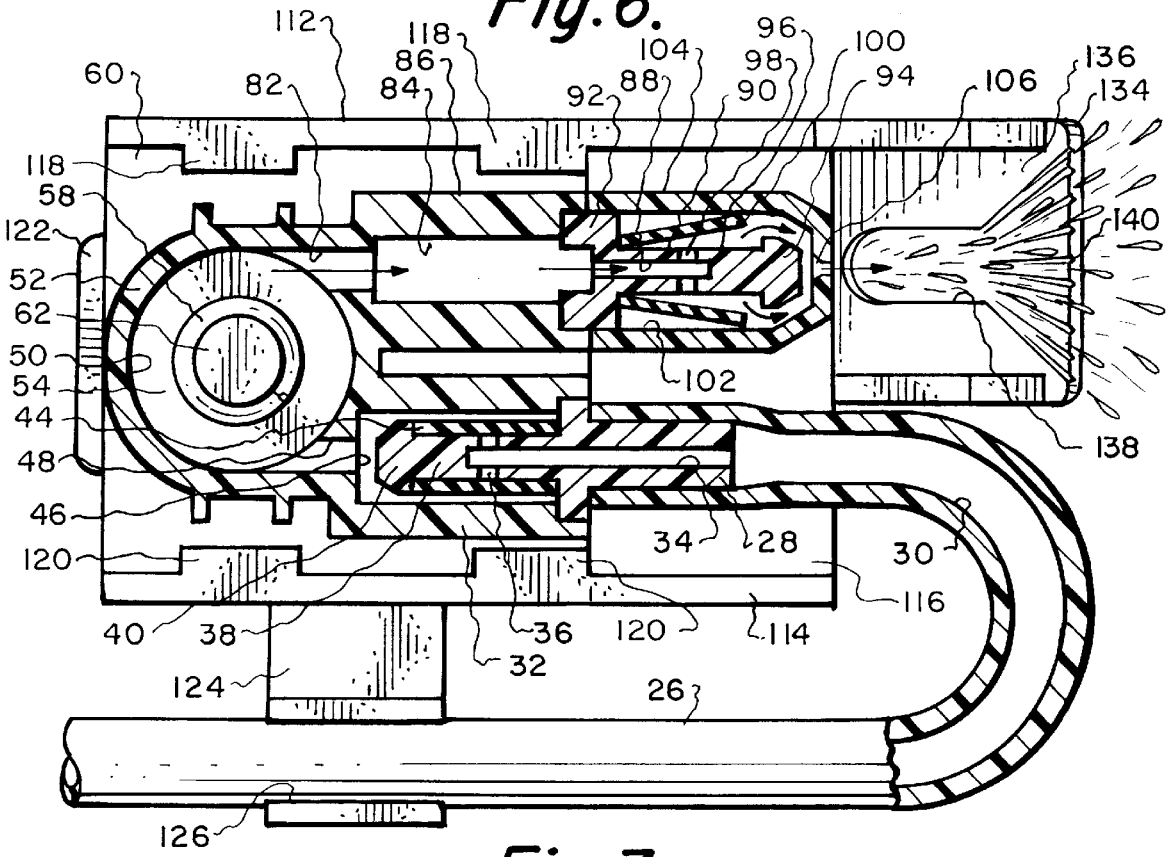
FIG. 7 is a view similar to FIG. 4 but showing the toilet deodorizer of the present invention in the position of dispensing of a quantity of the deodorizing liquid.

When a human user sits on seat 14, the seat 14 will pivot downwardly toward the bowl 10. This will result in piston 54 moving within the pump chamber 50 against the action of the coil spring 58. Hook members 68 and 70 will ride within their respective grooves 72 and 74. This compressive force is represented by arrow 142 in FIG. 6. The liquid that is contained within the pump chamber 50 is forced in the direction of arrows 144 through the outlet chamber 84, through the passage 88 and out through the outlet orifice arrangement 98. This will cause the resilient sleeve 100 to be unseated, as is clearly shown in FIG. 7 of the drawings. The liquid is then to enter the nozzle chamber 102 and then to be discharged forcefully in the form of a single stream through the nozzle opening 106. This single stream is squirted against the main groove 138 of the deflecting surface 136. This stream of liquid, as a result, is broken up into droplets, as shown in FIG. 7, to widely disperse the liquid within the interior of the toilet bowl 10. This deodorizing liquid 146 is to function to eliminate noxious odors contained within the toilet bowl 10. The composition of the deodorizing liquid is not part of this invention as such liquids are well known and there are many different liquids available.

Figure 8:
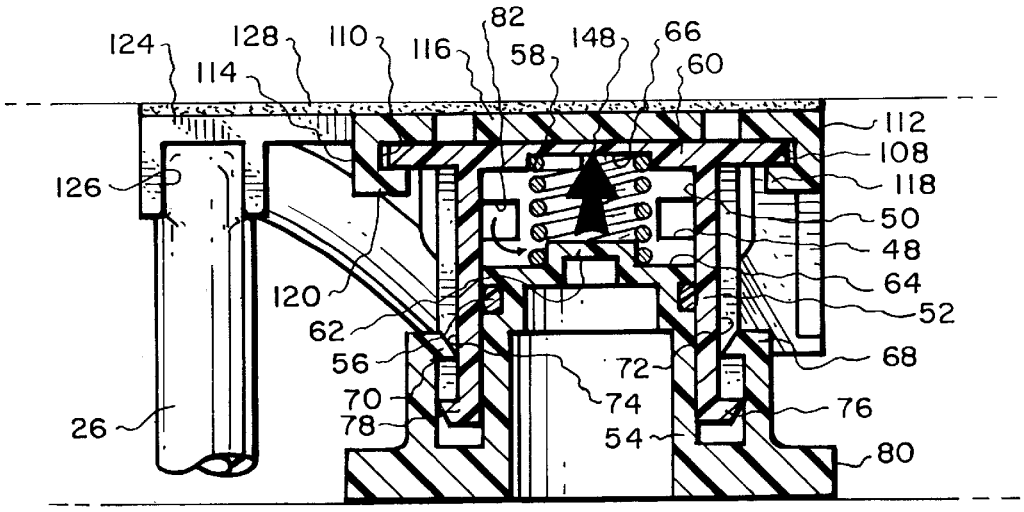
FIG. 8 is a view similar to FIG. 5 but showing the pump housing of the toilet deodorizer of the present invention in the position of moving from the compressed position to the expanded position which causes liquid to be moved from the storage reservoir to within the pump chamber.
Figure 9:
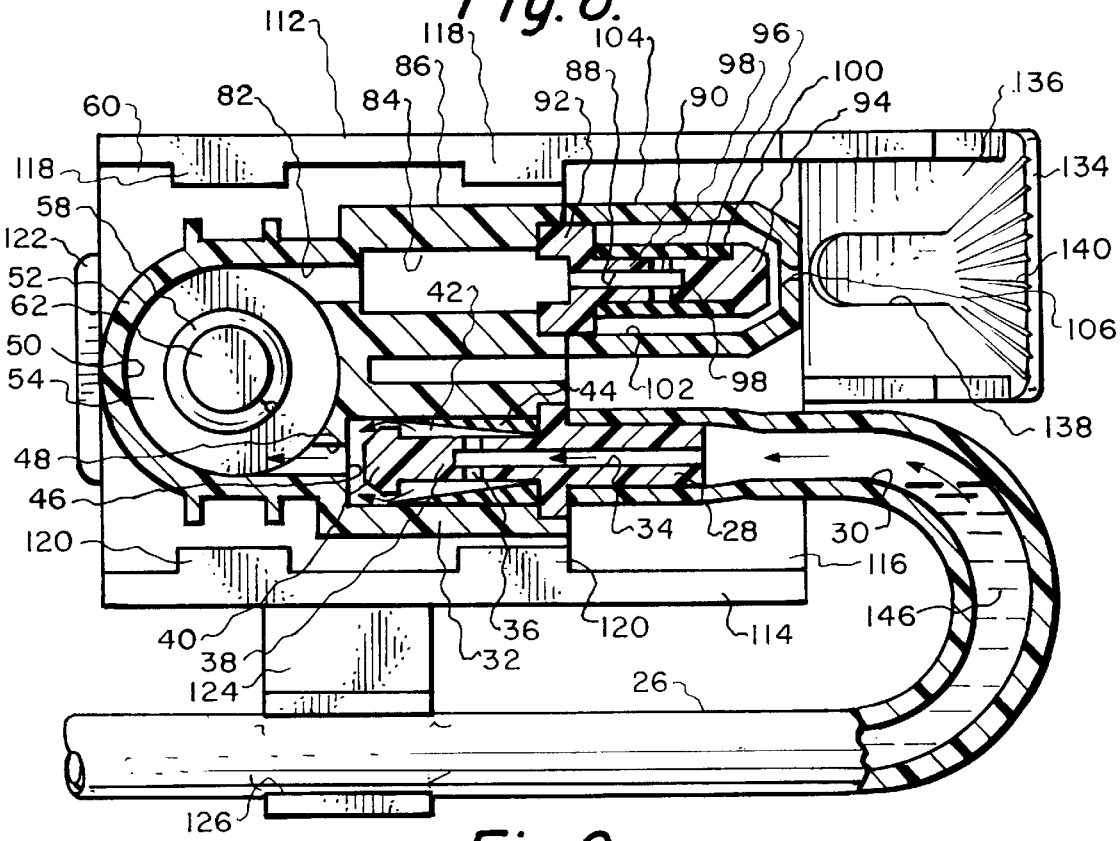
FIG. 9 is a view similar to FIG. 7 but showing liquid being drawn from the storage reservoir to within the pump chamber.

When the user gets up from the toilet seat 14, the toilet seat 14 will automatically lift due to the action of the spring 58 and cylinder 54 will move back to the expanded position shown in FIG. 5 of the drawings. This expansion caused by upward movement of the toilet seat 14 is depicted by arrow 148 in FIG. 8. At this particular time, a suction action will be created within the pump chamber 50. This suction will tend to keep the resilient sleeve 100 into tight connection with the outlet valve shaft 90 closing off of the orifice arrangement 98. However, this suction will also cause the inlet resilient sleeve 44 to be unseated which will permit the deodorizing liquid 146 to flow through passage 34, the inlet orifice arrangement 36 into the inlet chamber 46 and through passage 48 into within the pump chamber 50 filling such. When the pump chamber 50 is completely filled, the resilient sleeve 44 will then reseat itself against the annular recess 42 closing off of the inlet orifice arrangement 36 not permitting passage of any further deodorizing liquid 146 to within the pump chamber 50.

In order to insure that during this suction action that there will be no backflow from the nozzle chamber 102, the diameter of the outlet valve shaft 90 is designed to be slightly larger than the inlet valve shaft 38. This size differential will insure that it will always be that the resilient sleeve 44 will be unseated with the resilient sleeve 100 remaining seated.

What is claimed is:

1. A toilet deodorizer comprising:

a pump housing defined by a cylinder and a piston interconnected in a fluid tight manner, said pump housing enclosing a pump chamber;

biasing means mounted in said pump chamber, said biasing means exerting a continuous bias between said cylinder and said piston tending to locate said pump chamber in an expanded position, said piston being movable relative to said cylinder to a compressed position by the application of a manual compressing force between said piston and said cylinder;

a liquid inlet valve connected to and being part of said pump housing, a liquid outlet valve connected to and being part of said pump housing, moving of said piston to said compressed position causes liquid contained within said pump chamber to be dispensed through said outlet valve, movement of said piston from said compressed position causes liquid to be drawn through said inlet valve within said pump chamber;

whereby at each movement of said piston to said compressed position a precise quantity of the liquid is dispensed through said outlet valve; and a deflector plate, said pump housing being removably engaged with said deflector plate, by means of a rail assembly said deflector plate functioning to widely disperse the liquid at a receiving location by receiving a propelled stream of the liquid causing the stream to break up into droplets and be propelled from said deflector plate to the receiving location.

2. The toilet deodorizer as defined in claim 1 wherein:

said outlet valve having an outlet valve opening, said deflector plate having a deflecting surface positioned directly adjacent said outlet valve opening but spaced therefrom, when liquid is being dispensed in a stream from said outlet valve opening said stream to contact said deflector plate becoming said droplets and be deflected in a plurality of different directions when leaving said deflector plate.

3. The toilet deodorizer as defined in claim 1 wherein:

said outlet valve includes a first resilient sleeve surrounding an outlet orifice arrangement mounted within an outlet shaft, said first resilient sleeve normally closing off of said outlet orifice arrangement preventing flow of liquid through said outlet valve, movement of said piston to said compressed position causes said first resilient sleeve to be unseated permitting of flow of liquid through said outlet orifice arrangement.

4. The toilet deodorizer as defined in claim 3 wherein:

said inlet valve including a second resilient sleeve surrounding an inlet orifice arrangement mounted within an inlet shaft, said second resilient sleeve normally closing off of said orifice arrangement preventing flow of liquid through said inlet valve, movement of said piston to said expanded position causes said second resilient sleeve to be unseated permitting flow of liquid through said inlet orifice arrangement.

5. The toilet deodorizer as defined in claim 4 wherein:

said inlet shaft being of a smaller diameter than said outlet shaft to thereby insure that during the flow of liquid through said inlet valve that no flow of liquid will occur within said outlet valve.

* * * * *